US006915853B2

(12) United States Patent
Bakke et al.

(10) Patent No.: US 6,915,853 B2
(45) Date of Patent: Jul. 12, 2005

(54) METHOD AND DEVICE FOR PERFORATING A PORTION OF CASING IN A RESERVOIR

(75) Inventors: Stig Bakke, Algard (NO); Per Buset, Stavanger (NO)

(73) Assignee: PGS Reservoir Consultants AS, Lysaker (NO)

( * ) Notice: Subject to any disclaimer, the term of this patent is extended or adjusted under 35 U.S.C. 154(b) by 32 days.

(21) Appl. No.: 10/326,765

(22) Filed: Dec. 20, 2002

(65) Prior Publication Data

US 2003/0213590 A1 Nov. 20, 2003

Related U.S. Application Data

(63) Continuation of application No. PCT/NO01/00264, filed on Jun. 22, 2001.

(30) Foreign Application Priority Data

Jun. 28, 2000 (NO) ..... 20003369

(51) Int. Cl.[7] ..... E21B 43/112

(52) U.S. Cl. ..... 166/298; 166/55.1; 166/55.7; 175/62; 175/78; 175/80

(58) Field of Search ..... 166/298, 55.7, 166/55.1; 175/62, 78, 80, 424

(56) References Cited

U.S. PATENT DOCUMENTS

| | | | |
|---|---|---|---|
| 4,790,384 | A | 12/1988 | Schellstede et al. |
| 4,928,757 | A | 5/1990 | Schellstede et al. |
| 4,932,129 | A | 6/1990 | Schellstede et al. |
| 5,183,111 | A | 2/1993 | Schellstede et al. |
| 5,392,858 | A | 2/1995 | Peters et al. |
| 5,413,184 | A | 5/1995 | Landers |
| 5,853,056 | A | 12/1998 | Landers |
| 6,125,949 | A | 10/2000 | Landers |
| 6,167,968 | B1 | 1/2001 | Allarie et al. |

*Primary Examiner*—David Bagnell
*Assistant Examiner*—Giovanna M. Collins
(74) *Attorney, Agent, or Firm*—E. Eugene Thigpen

(57) ABSTRACT

In connection with a method and a tool for preparing a well for the production of hydrocarbons, it is aimed at perforating a casing portion (26) and working surrounding sediment (80) in a channel-forming manner. For this purpose the tool comprises a drilling means for drilling transverse holes through the casing wall when the tool (10), which is arranged to be raised/lowered and rotated about its longitudinal axis, shared by the casing (26), is placed in a fixed position within the well, through which transverse hole (40) and into surrounding sediment a jetting hose means (42,42*a*) is arranged to jet/dig its way in a channel-forming manner. The drilling and jetting hose means also have inactive stand-by positions protectively retracted within the tool housing (10*a*), from and into which they may successively be pushed forward into active working positions and again be withdrawn, as a channel (44) is completed in the sediment (80).

8 Claims, 17 Drawing Sheets

METHOD AND DEVICE FOR PERFORATING A PORTION OF CASING IN A RESERVOIR

CROSS-REFERENCE TO RELATED APPLICATION

This application is a continuation application filed pursuant to 35 USC § 120 claiming priority under 35 USC § 365 to PCT patent application Ser. No. PCT/NO 01/00264 filed on Jun. 22, 2001 and under 35 USC § 119(a)–(c) or 365(b) to Norwegian Patent Application No. 2000 3369, filed on Jun. 28, 2000, on which said PCT patent application Ser. No. PCT/NO 01/00264 was based.

This invention relates to a method and a tool adapted with a view to making holes through a portion of casing located in the hydrocarbon-bearing layer of a reservoir in order to open to inflow of hydrocarbons by the prevailing reservoir pressure into the well, the tool enabling a compaction-preventing loosening of granular firm sedimentary formation rock, e.g. sedimentary rocks like sandstone and limestone sediments of a moderate firmness/hardness degree, so that a jetting means according to the invention may move in a channel-forming manner into the sediment, starting from a hole through a casing wall drilled immediately before, as will be explained later.

Conventional technique for the perforation of the wall of said casing portion has been to winch down explosives from a surface position to the desired location for the making of the holes, and then make them explode by a remote-controlled operation. Thereby a fairly satisfactory perforation of the casing portion in question is achieved, but this known perforating method is wanting and disadvantageous in other respects.

A serious disadvantage of this perforating explosion has been that it tends to cause packing and compacting of the surrounding grains of sediment. This is exactly the opposite of what is convenient and desirable, namely a loosening of the granular sedimentary masses round the perforated portion of the casing in the hydrocarbon-bearing layer of the reservoir.

In accordance with the present invention, the aim has thus been to indicate a rational, appropriate approach to avoid said packing and compacting of non-firm, granular formation structure during the actual perforation of the casing portion, wherein the formation structure is loosened in an adjacent area, within the presumably hydrocarbon-bearing layer of the reservoir, so that it becomes looser with a view to enhancing the flow of the hydrocarbons towards the casing perforations.

Perforation of the casing portion and jetting and forming of channels in the surrounding sediment also offer convenient side effects and advantages in other respects. For example, it may be possible to perforate the casing at a distance from existing perforation and thereby penetrate into hydrocarbon-bearing layers, the recovery of which would not have been profitable according to known technique.

According to the invention, to implement this method a perforating and jetting tool should be provided, in which the jetting/loosening/channel-forming means of the tool, which should be able to work their way into the moderately hard sedimentary layer to form radial/transverse cannels and at the same time loosen the sedimentary rock consistency in the areas round the channels, receive a supply of pressurized fluid subjected to a nozzle effect, wherein jets of liquid are directed partly forwards and partly rearwards relative to the direction of penetration of the jetting means into the formation.

Said object is realized by means of the method and the tool, which distinguish themselves, according to the invention, through the features appearing from the characterizing part of the following Claims.

According to the invention, a subsea well, for example, is entered by a downhole tool comprising a jetting hose wound on a drum, and drilling equipment and fixing/securing means serving to secure the drilling equipment at its fixed-level position within the well while it is performing its task.

Said drilling means/jetting hose may be brought to change its position through a change of the position of the tool, for example by rotation thereof about the axis of the casing string and/or by lowering or raising thereof.

The drilling means is brought to drill a transverse hole through the pipe wall, and through the predrilled hole, the jetting means is then inserted after a corresponding change of level of the tool.

The jetting means has the form of a flexible tubular channel-forming loosening element, preferably in the form of a flexible/semi-rigid jetting hose with an outer, free terminal head, which is arranged to work its way, by water supply/nozzle effect, in between the sediment grains by a jetting/digging action loosening the sediment structure in an advantageous way before production commences.

As both the perforating means and jetting means may be brought to change position both heightways and circumferentially relative to the well, that is through the positional changes of the tool, there is actually need for just one single perforating means and one single jetting/loosening means, and the use of such single means entails great advantages as compared to embodiments, in which a group of means of each kind is fitted.

The hole-making/perforating means for the drilling of holes through the casing wall, in the form of a drilling device, is arranged to perforate the casing wall portion in question, and one single drilling means drills out a single hole at a time. Eventually, these holes will be staggered to each other along the height and circumference according to a desired, controlled and predetermined pattern; this is in contrast to the highly uncontrolled distribution of holes which is the result of a conventional blow-up of explosives.

The use of one single jetting/sediment-loosening means in the is form of a jetting hose provided with a nozzle head is advantageous above the use of several such jetting hoses, because in the single-hose embodiment there will be more room and it will be far easier to arrange a necessary storing device (drum) and means for feeding out/in the hose during its pushing out and withdrawing motion relative to the internal cavity of the elongated tubular tool.

During these outward and inward movements relative to the tool housing, the jetting hose passes through one of the through transverse holes that the perforating means (drilling device) made in the casing wall in a preceding operation.

However, within the scope of the present invention tools comprising more than one perforating/drilling means and/or more than one jetting/sediment-loosening means, and also a rational method, in which such a tool is used, are highly conceivable.

A greatly elongated, rectilinear, sleeve-shaped/tubular tool housing for a perforating/jetting tool according to the invention may in principle comprise a series of sections in the form of components of mutually differing part-functions of the main functions of the tool, and these sections/components are arranged so that they follow one behind the other along the length of the tool. Enumerated from the upstream end to the downstream end, referring to the lowering of the tool into a vertical well, the greatly elongated sleeve-shaped/tubular tool according to the present invention may include:

(a) a so-called "control package" containing electronics, pump and valves arranged to monitor and control hydraulic functions in means and devices positioned downstream of said control package;

(b) an anchoring device of a kind known in itself and arranged to enable securing of the tool at/in fixed levels and positions heightways and circumferentially;

(c) a device for the rotation of the tool to change the working position of the drilling means or jetting means;

(d) an extendable/shortenable torque-absorbing cylinder which is arranged to absorb occurring torques;

(e) jetting hose drum with a feeding device for the jetting/sediment-channel-forming and -loosening hose;

(f) a drilling device for the perforating a casing wall portion, preferably by individually drilling the holes in a controllable predetermined perforation pattern, and a holding-up means for the drilling device; and (g) a motor for driving the drilling device.

Said anchoring device (b), which provides fixed-position securing of the tool, may comprise one of several known embodiments of appropriate securing devices, comprising for example a radially expandable/contractible locking ring with external friction-creating/-increasing means in the form of radial cuneiform projections, ribs, points, grapple teeth, friction coating etc. which are brought into position, bearing pressingly on the internal surface of the casing.

A normal work cycle of such a downhole tool is that said cuneiform locking means is forced radially outwards to be brought to adopt its outer expanded tool-position-fixing locking position, so that the tool is secured in a fixed-level working position.

The holding-up means, which may be arranged at the lower end of the tool and may have a transverse reciprocating motion relative to the longitudinal axis of the tool housing, is activated by way of hydraulics and is thereby forced radially outwards against the internal surface of the casing wall.

Then the drilling device is put into operation by means of the motor, after which a desired number of holes is drilled through the casing wall at this level, the drilling device being rotated a desired number of degrees between each drilling operation.

The rotation of the drilling device is done by way of said rotating device (c), which is arranged to rotate the drilling device so that its axis may be brought successively/in steps to run through 360°. Normally it will be preferred to drill a hole and then immediately carry out a jetting/channel-forming operation through one hole at a time, so that a full sequence is carried out a desired number of times.

By means of said cylinder (d) the drilling device is moved down to another level, so that the jetting device with the working/nozzle head is brought into a correct height position directly in front of, aligned with, the predrilled hole in the casing wall.

From nozzles arranged in the nozzle head, the liquid jets are directed both in the moving direction of the working head and in the opposite direction, the rearward nozzle jets contributing through a "jet effect" to pushing the jetting hose with the nozzle head into the formation sediment. The jetting hose itself is fed forward by means of for example an electric motor through a control means with switching/change-over means.

By excessive forced feeding speed relative to the real penetration speed of the jetting hose into the sediment of the formation, said switch/change-over means is activated, and its response to the actuation is utilized through the electronics of the control package (a) to make the driving motor rotate counter to its normal direction and thereby effect an amountwise insignificant but important withdrawal of the jetting hose.

The nozzles of the nozzle head of the jetting hose again push the jetting hose forward in the desired radial/transverse direction relative to the longitudinal axis of the tool, whereby the switch or change-over means reverts to its non-activated position, after which the hose drum may again resume its hose-feeding.

The jetting hose runs in a bed which is secured to a switch arm and exhibits a smooth coating. The jetting hose is wound onto a sleeve-shaped drum, which has a stationary point of support, at which it is rotatably supported by means of axial bearings, the rotation being implemented by means of a motor through gears cooperating with a gear rim in the drum.

The drum has two walls, the inner wall being provided with a threaded portion, which has essentially the same thread pitch as the pitch of coil of the wound jetting hose, with the aim of ensuring synchronous hose feed-out as a feeding sleeve is directed by gliding strips/grooves, so-called splines, the gliding strips being secured to an inner pipe secured to the tool, whereas gliding grooves are formed in the feeding sleeve. In this inner pipe is secured a telescopic pipe, which slides within a tubular portion of the feeding sleeve.

The invention will be described in further detail in the following in connection with non-limiting examples of preferred embodiments which are visualized in the appended drawings, in which.

Figure 2:
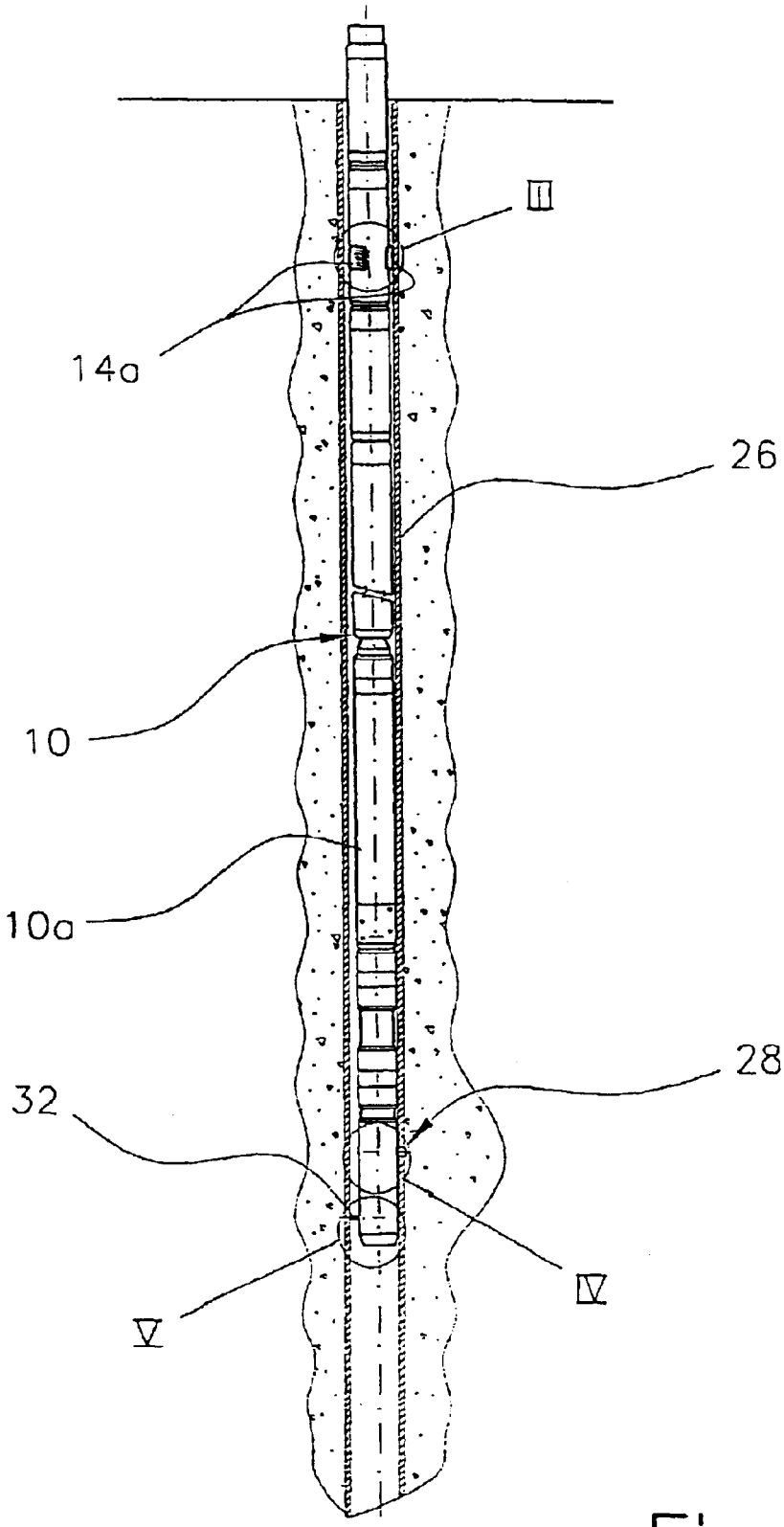
FIG. 2 shows the tool, in a side view and on a smaller scale than in FIG. 1, placed in a position of use coaxially inside a set and cemented string of casing, in a vertical longitudinal section, in which some details (shown in vertical sections in FIGS. 3–5) have been encircled.
Figure 3:
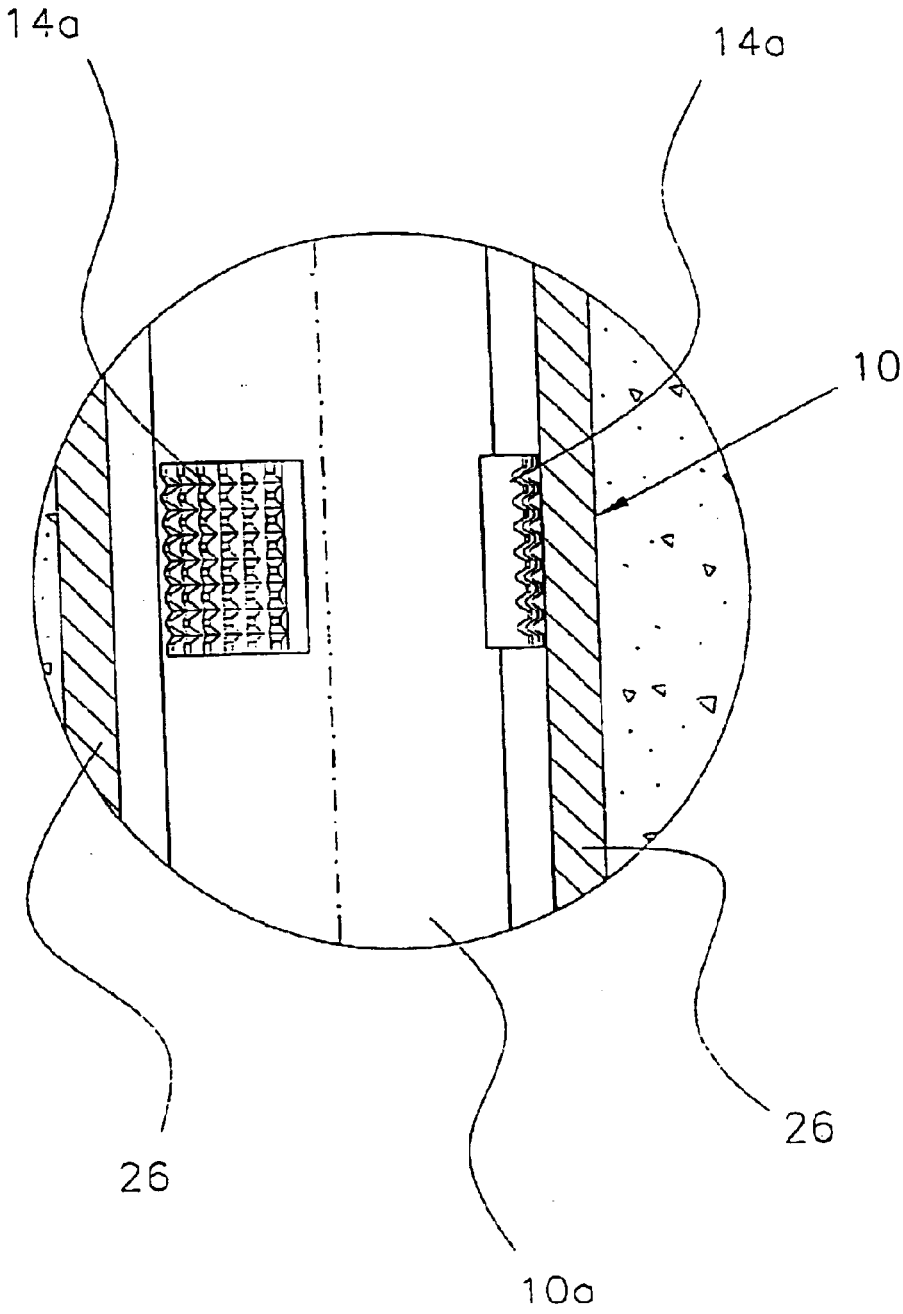
FIG. 3 is a first encircled detail portion III of FIG. 2, in which an anchoring device for fixing the position of the tool is shown on a scale considerably larger than the scale used in FIG. 2.
Figure 4:
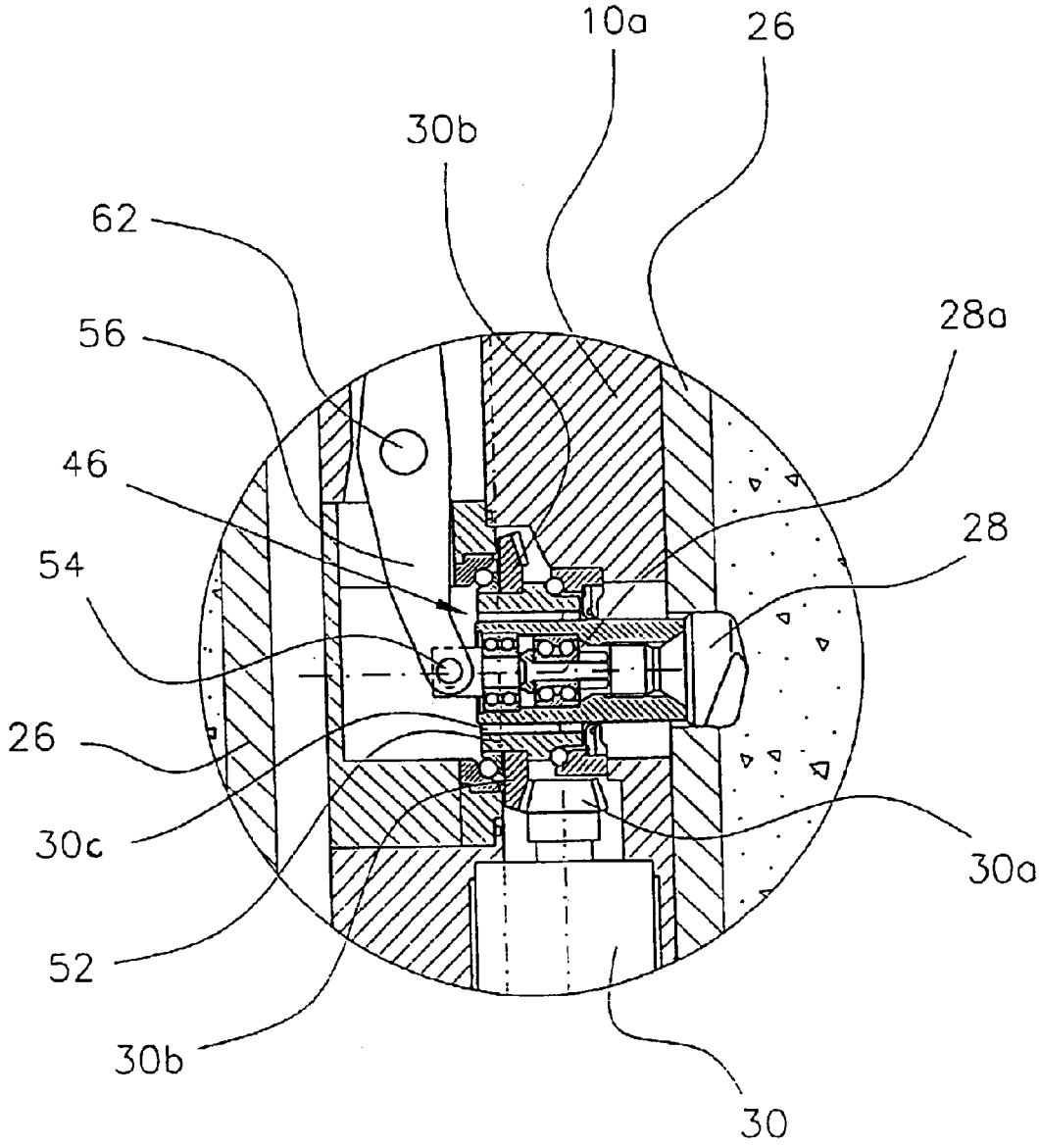
FIG. 4 is a second encircled detail portion IV of FIG. 2, and shows, in a side view/vertical section, a drilling device for perforating the casing wall by the drilling of individual holes.
Figure 5:
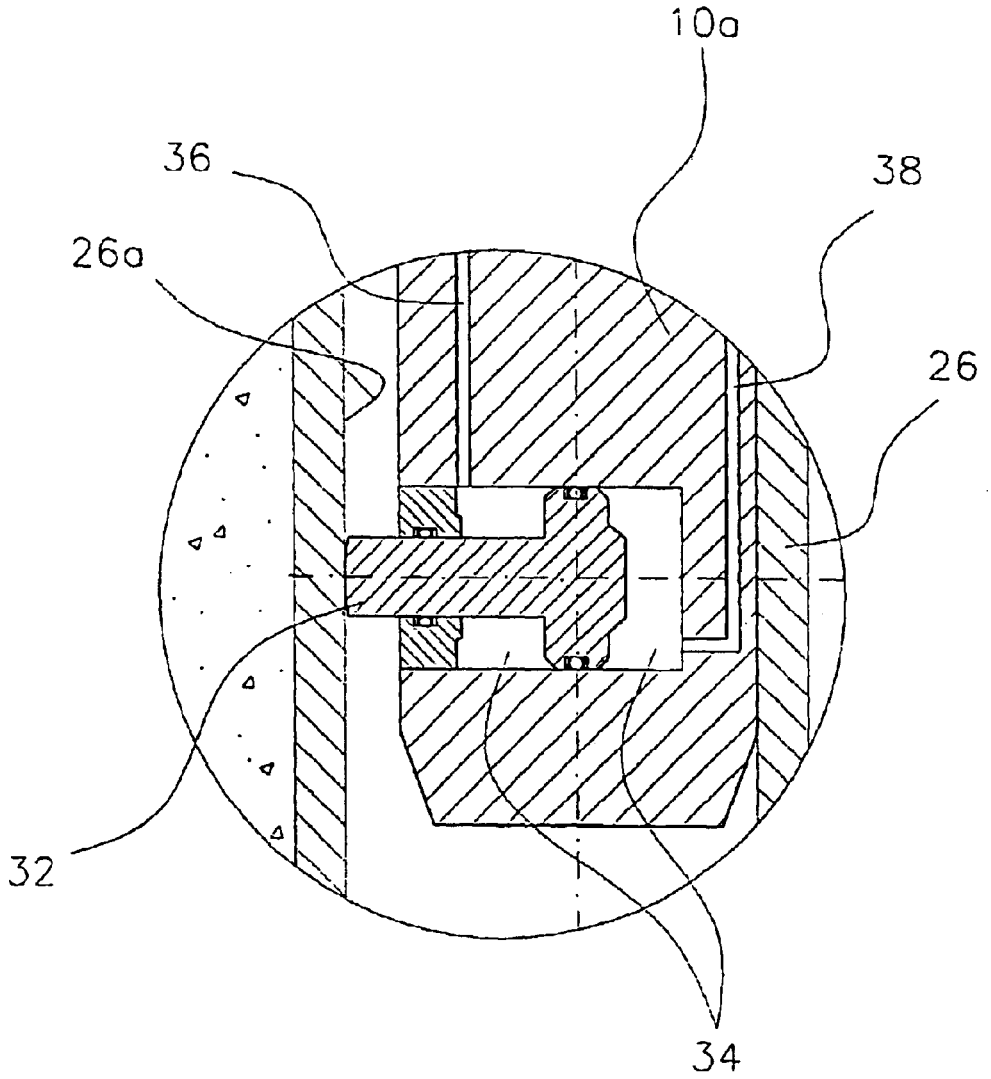
Figure 6:
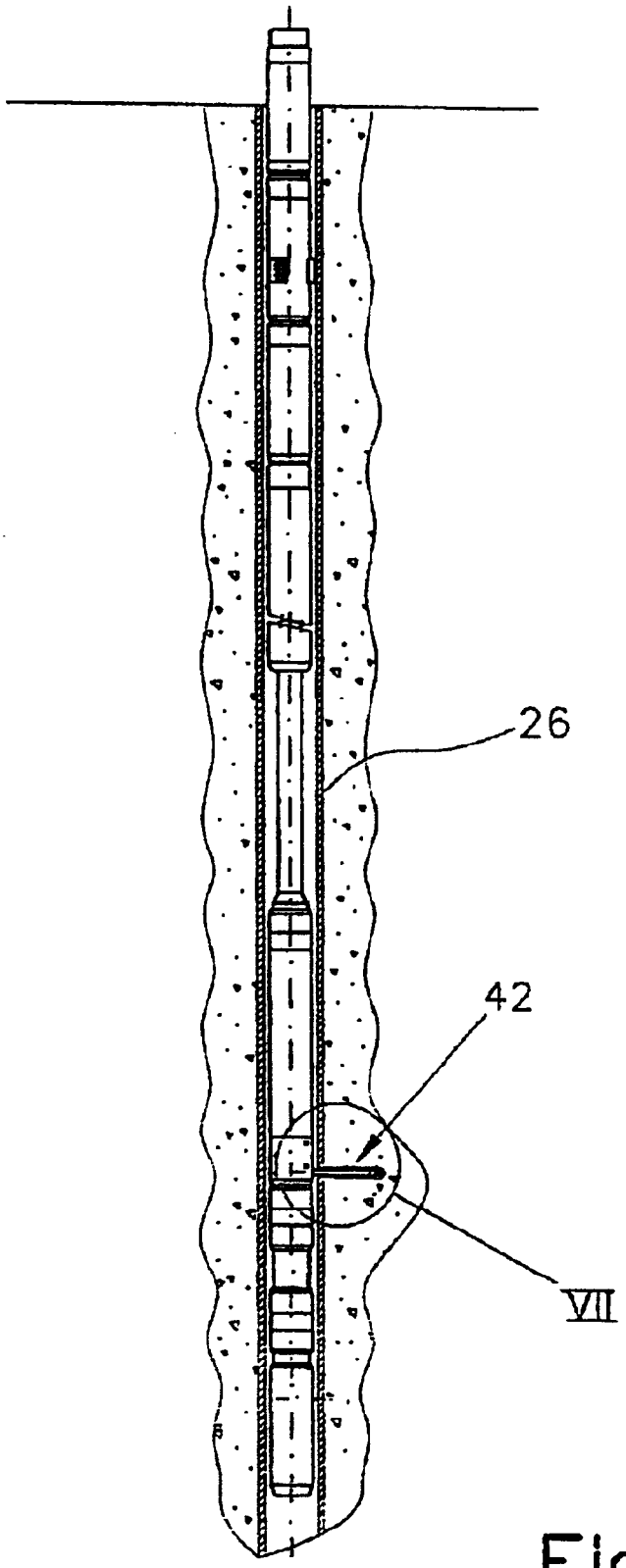
Figure 7:
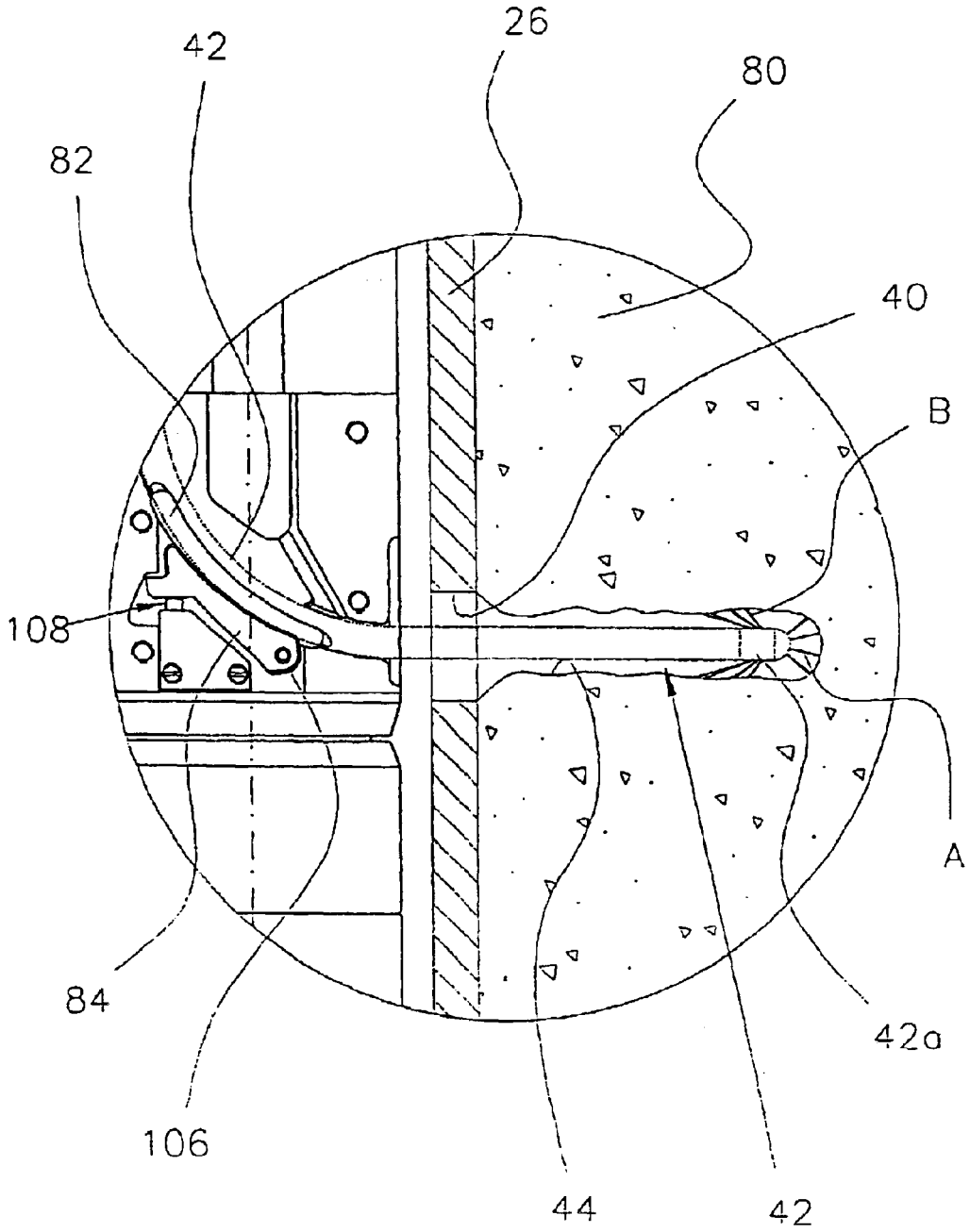
Figure 8:
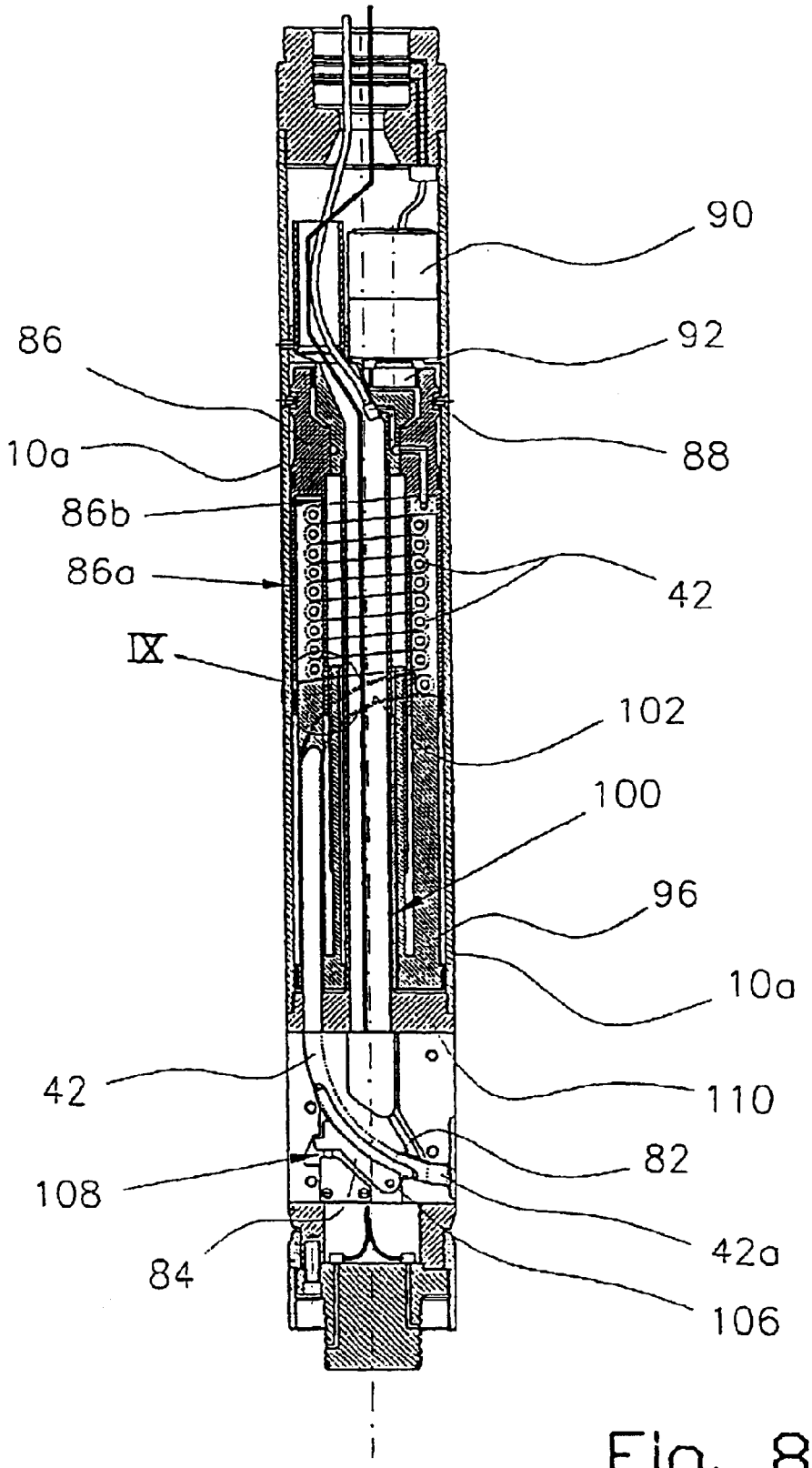
Figure 9:
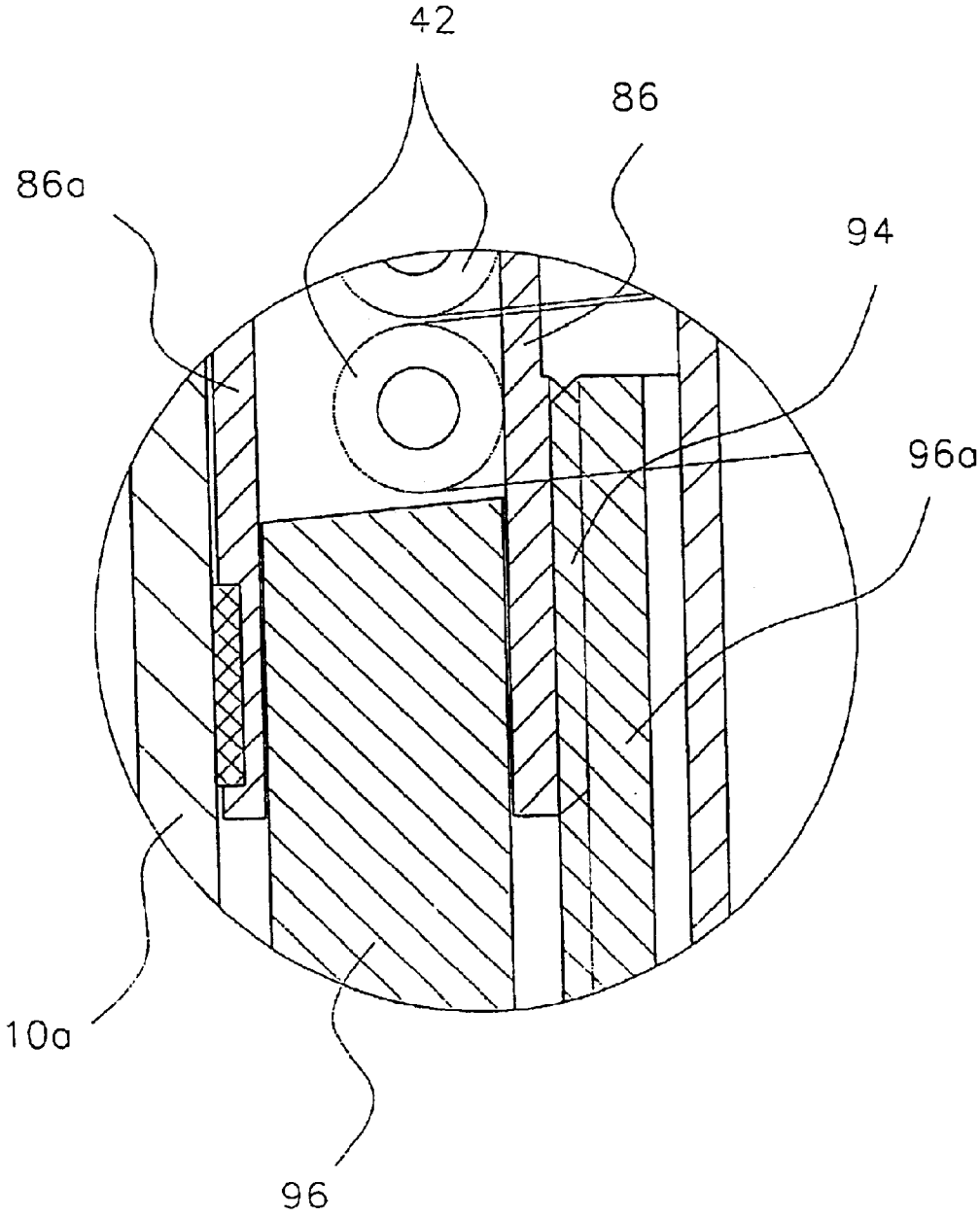
Figure 10:
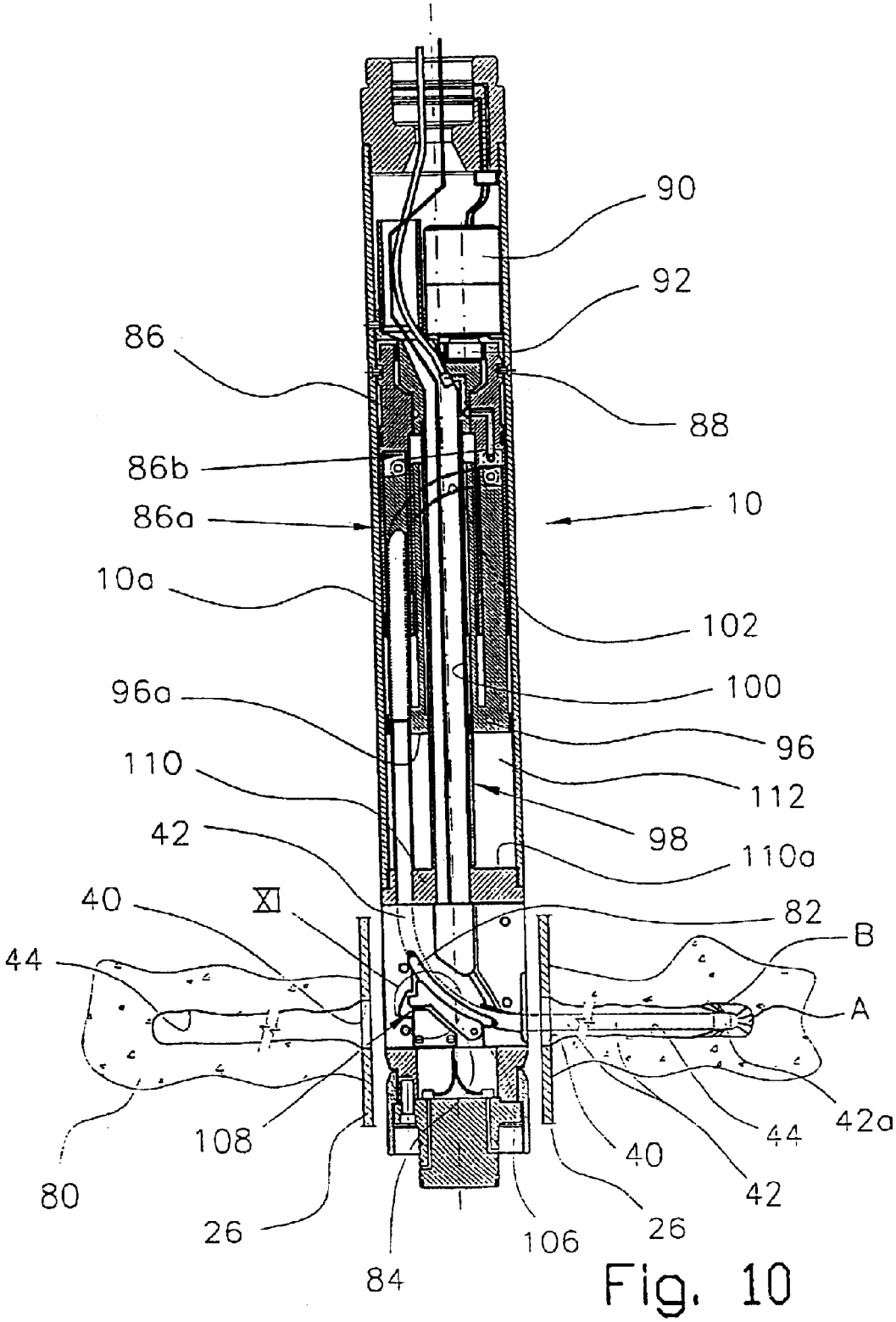
Figure 11:
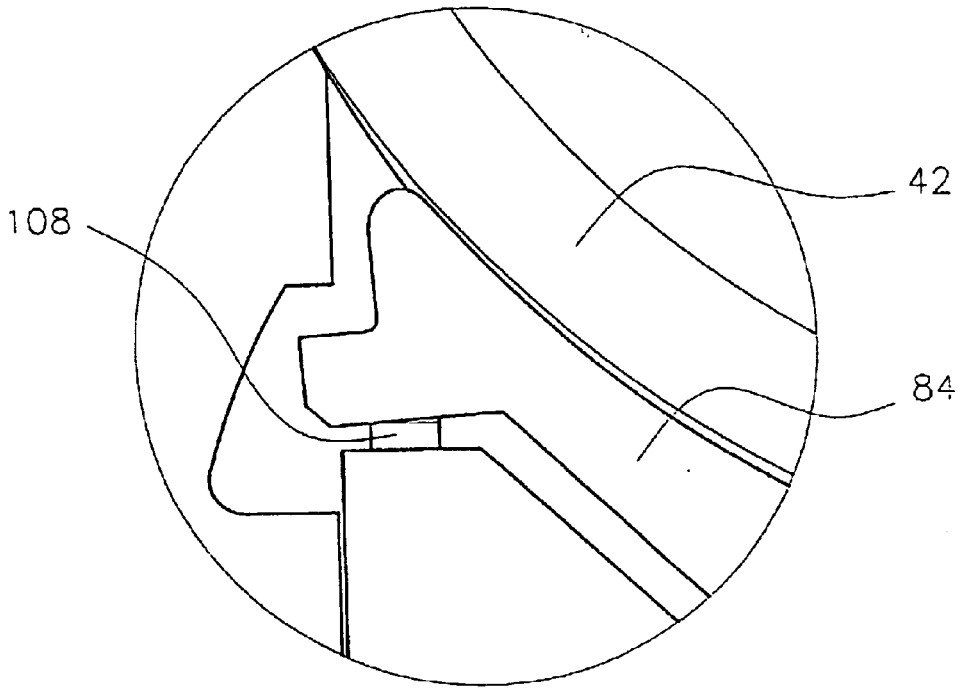
Figure 12:
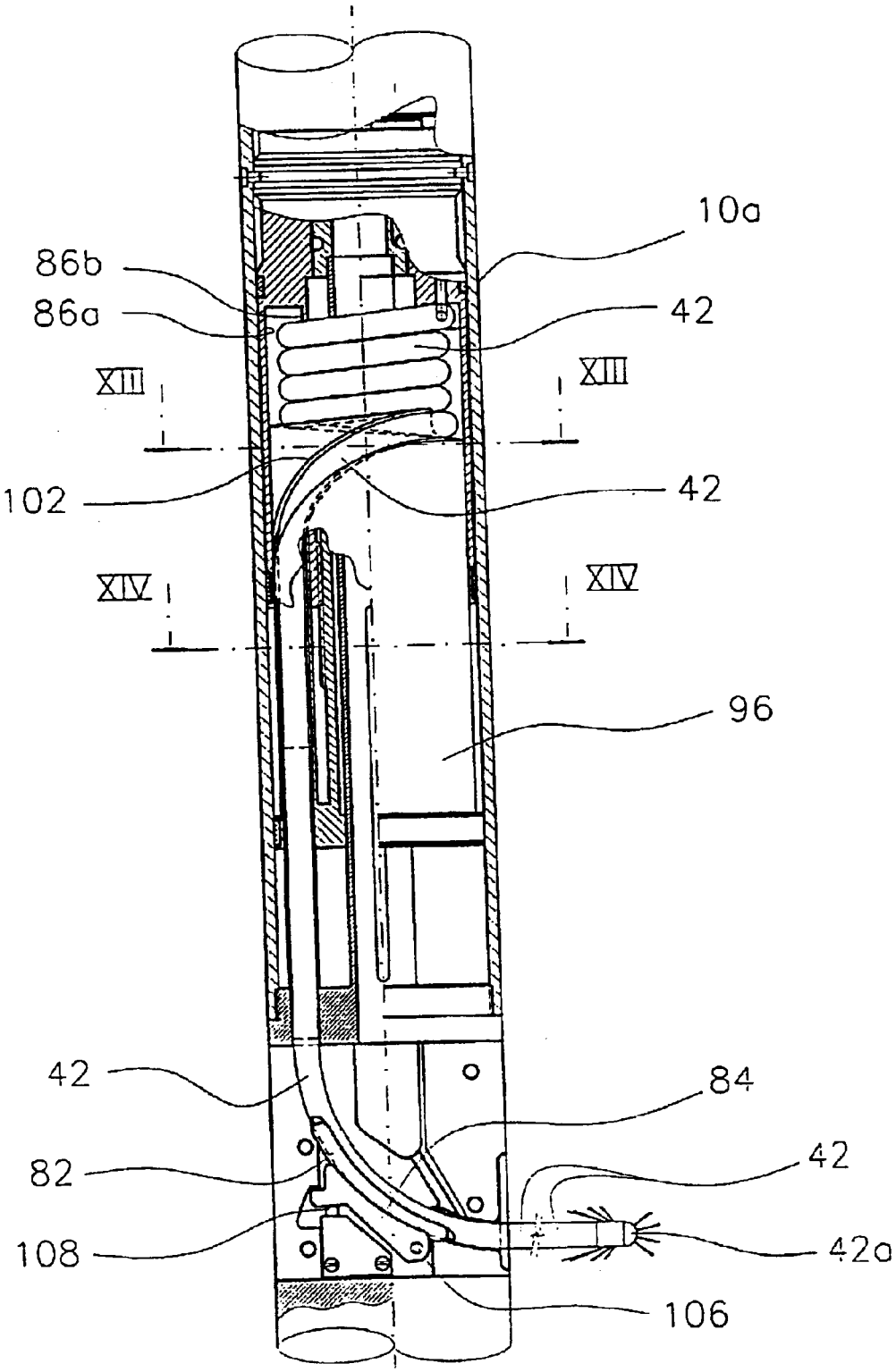
Figure 13:
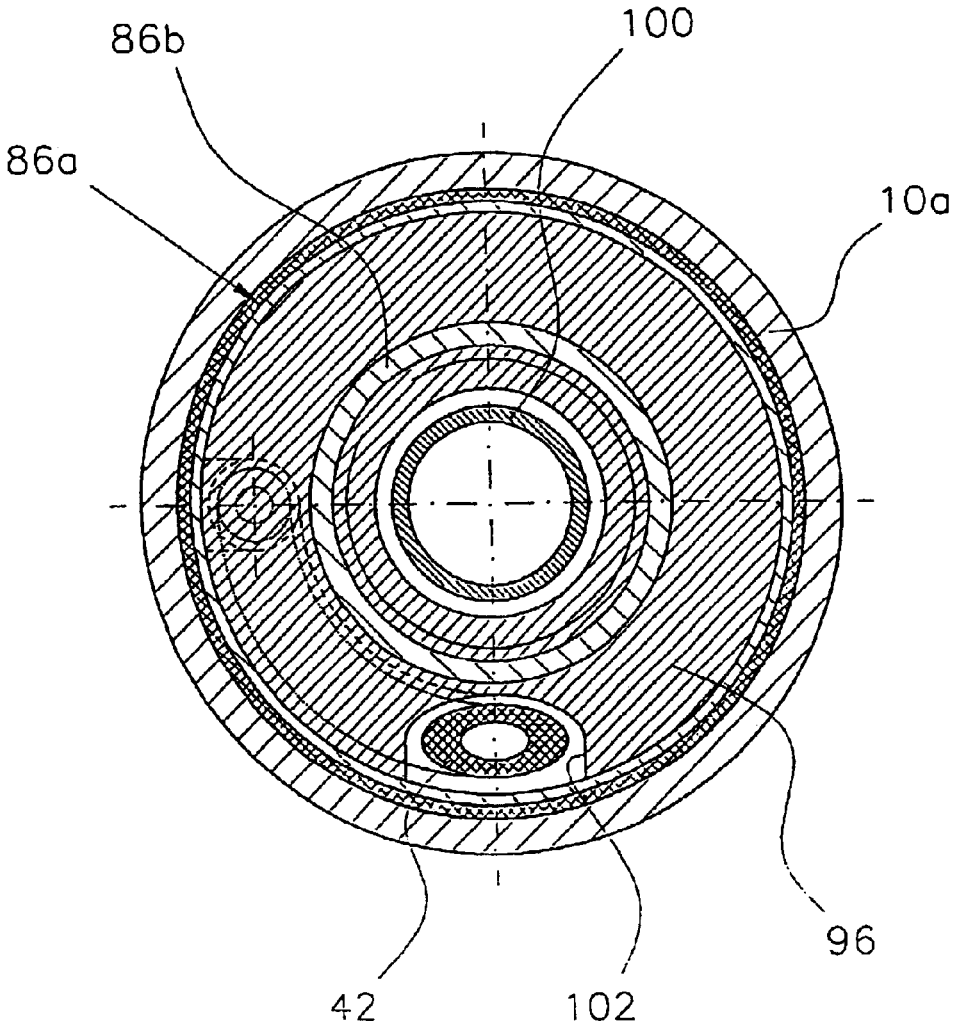
Figure 14:
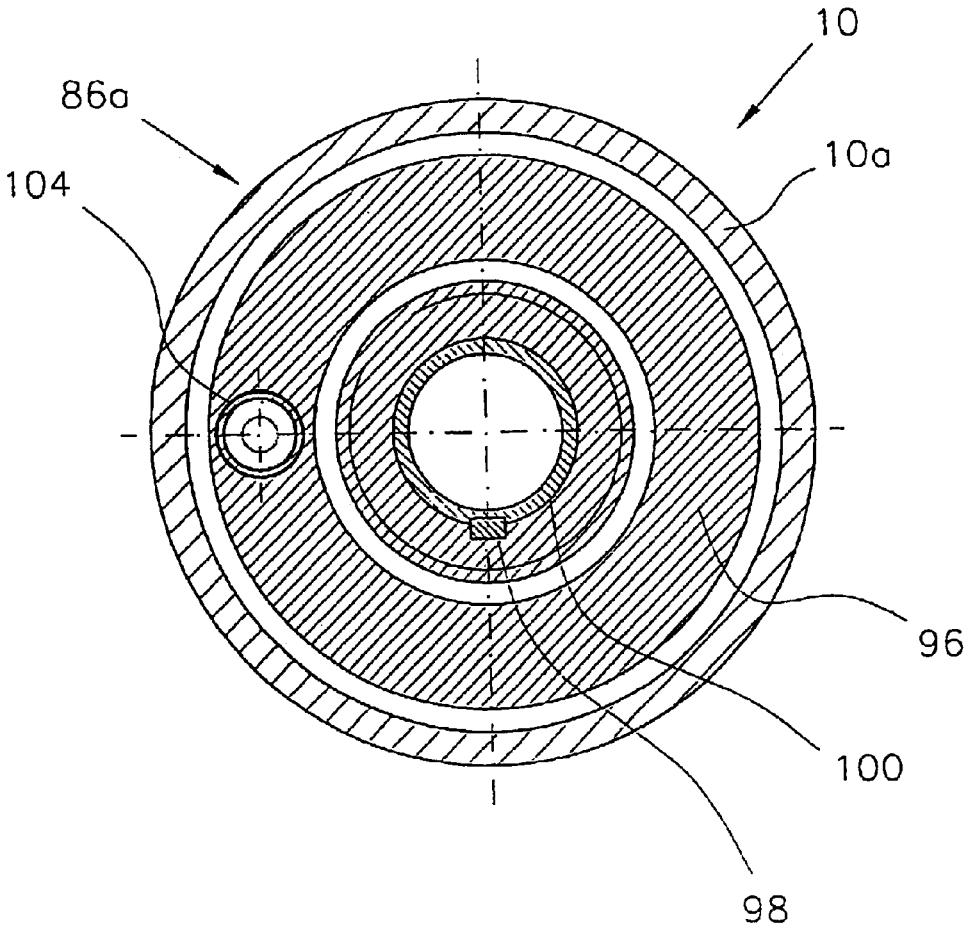
Figure 15:
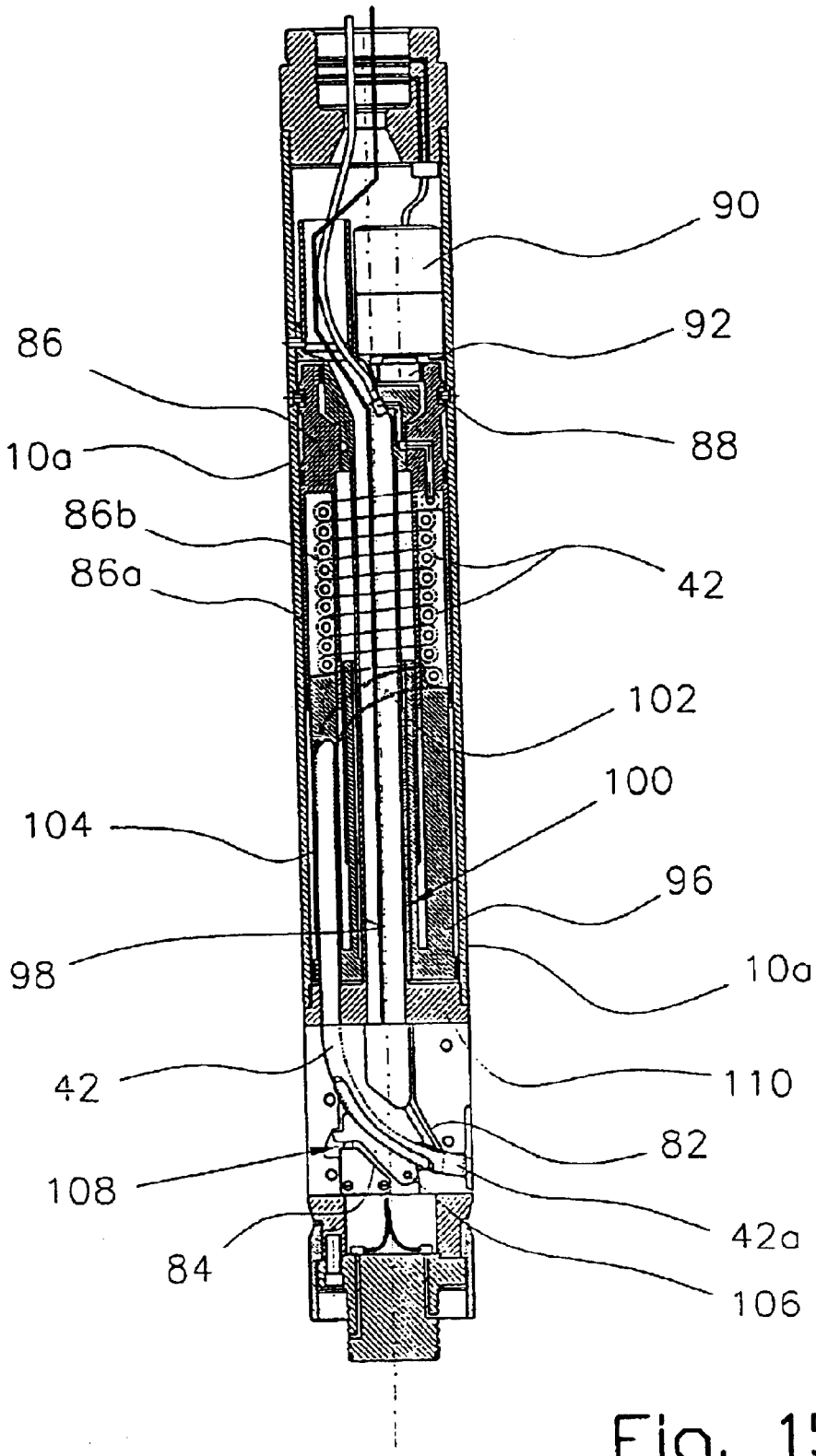
Figure 16:
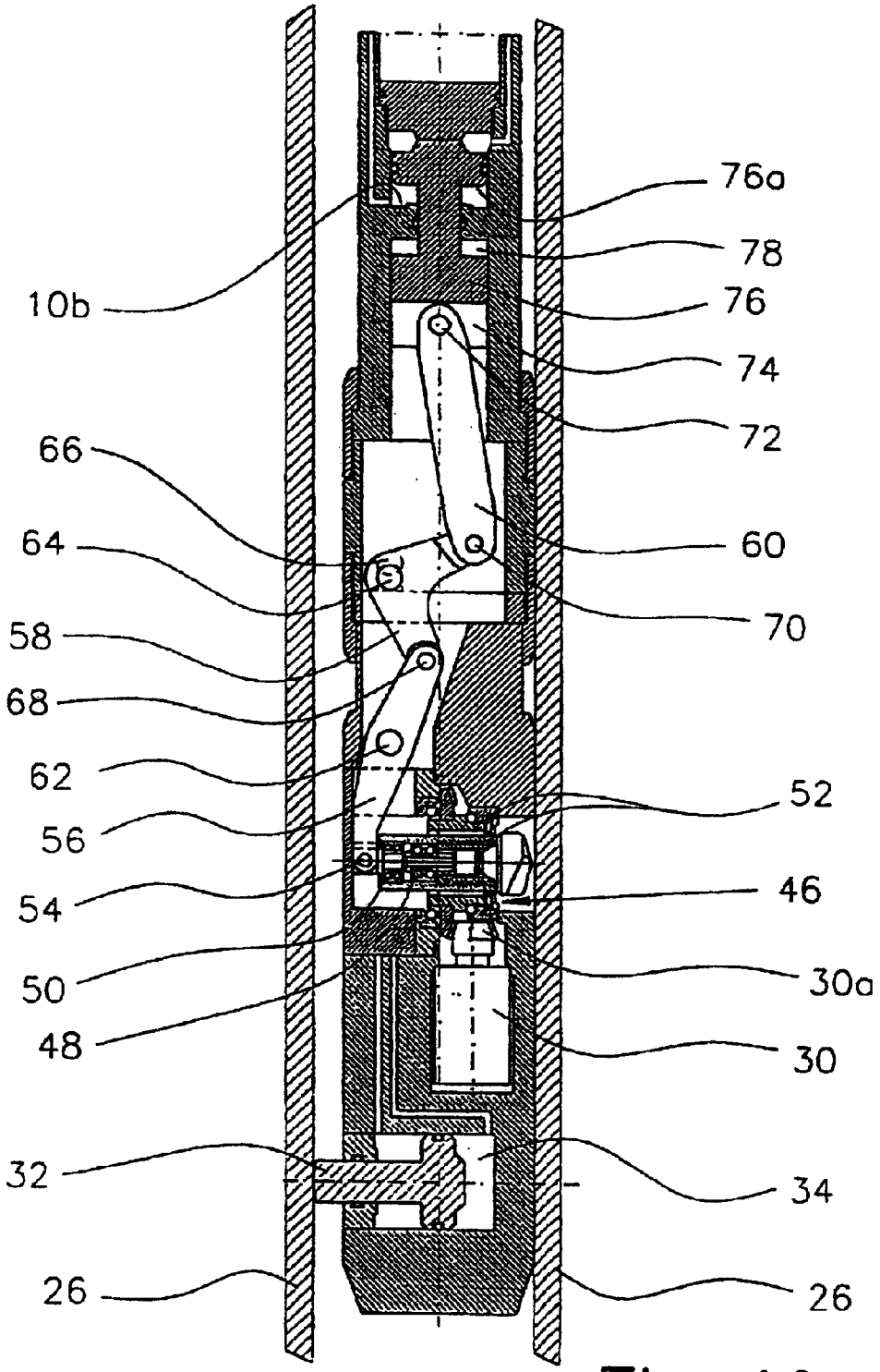
Figure 17:
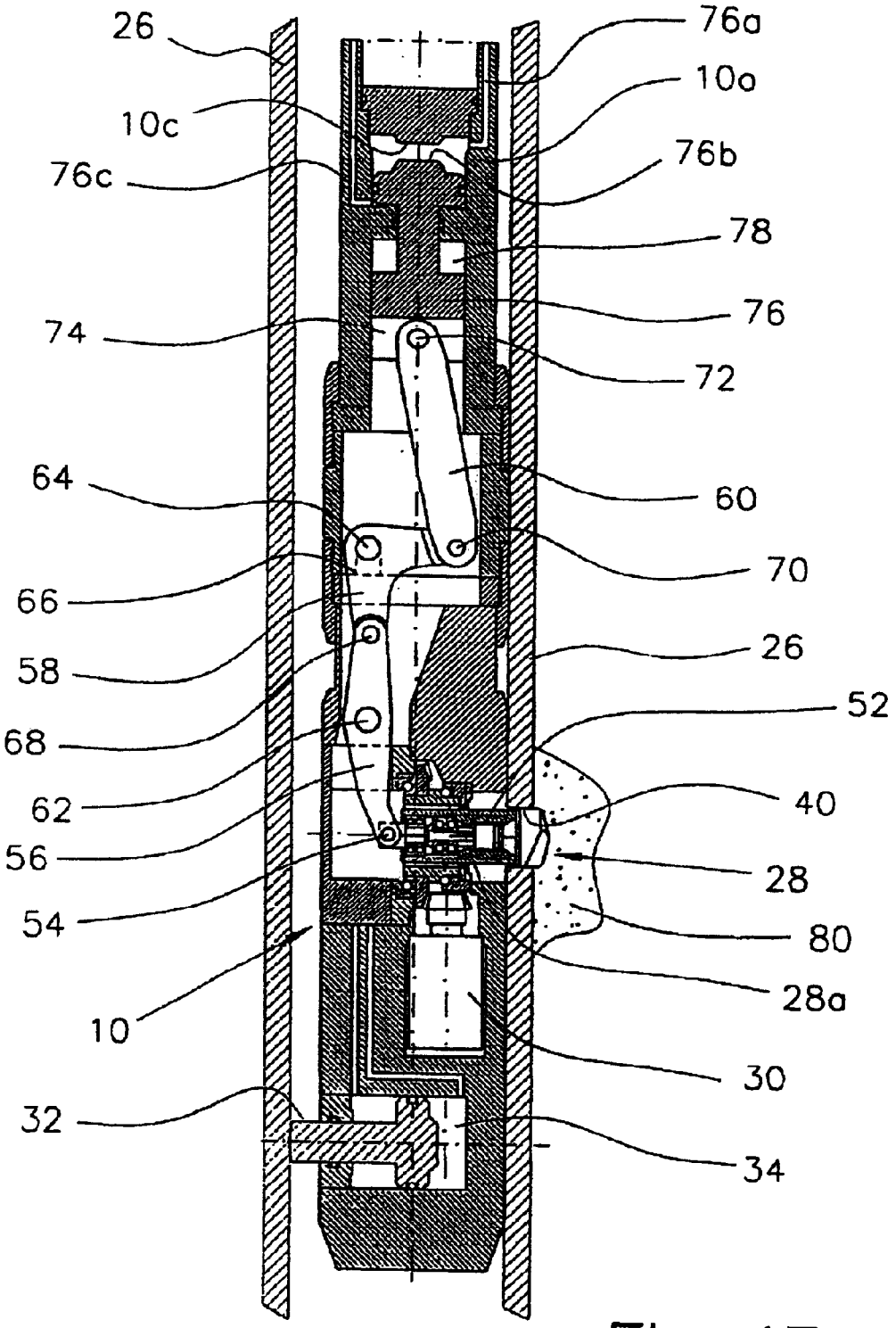

FIG. 5 is a third encircled detail portion V of FIG. 2 and shows, in a vertical axial section, a holding-up means incorporated in the tool and placed at the lower end thereof and also arranged to be reciprocated in the transverse direction (radially) in order to be forced into abutment against the opposite internal casing wall surface when the drilling device is to drill its way through the pipe wall;

FIG. 6 corresponds to FIG. 2, but shows that a jetting means has started to function and, in the form of a jetting hose, has been pushed out radially through the predrilled hole in the casing wall;

FIG. 7 corresponds to FIGS. 3–5 in embodiment and scale and shows the encircled detail portion VII of FIG. 6, the outer portion of the jetting hose being shown, both forward and rearward liquid jets from nozzles of the nozzle head of the jetting hose being suggested to illustrate the function of the jetting hose;

FIG. 8 is an elongated portion of the tool, i.a. in the area of the jetting hose, the winding drum, feeding/controlling device etc. thereof;

FIG. 9 is an enlarged detail view corresponding to the encircled portion IX of FIG. 8;

FIG. 10 is a vertical section corresponding to FIG. 8, in which the outer portion of the jetting hose with the nozzle head is inside one of two diametrically opposite holes in the formation;

FIG. 11 is a detailed partial view on a large scale, corresponding to the encircled portion XI of FIG. 10, from which it appears where a switch/change-over means is arranged, it being arranged to respond to excessive forced feeding speed relative to the real penetrating speed of the jetting hose nozzle head into the sediment;

FIG. 12 corresponds to FIG. 10, but shows a jetting hose feeding sleeve formed with slide grooves which cooperate with slide strips, splines, of an inner pipe;

FIG. 13 is an enlarged cross-sectional view along the line XIII—XIII of FIG. 12;

FIG. 14 is an enlarged cross-sectional view along the line XIV—XIV of FIG. 12; and FIG. 15 shows a partial view in a longitudinal section in the form of a longitudinal portion of FIG. 8 on a substantially larger scale;

FIG. 16 is an enlarged, detailed partial side view, partially in a longitudinal section, and shows a longitudinal portion of the tool from the lower end thereof, the holding-up means being active, pressing by its free end against the internal surface of the casing, the drilling means being in a radially retracted position, its maneuvering device, comprising a link arm mechanism driven by an axially displaceable press plunger, being in a corresponding position;

FIG. 17 corresponds to FIG. 16, but shows the drilling means in an active position, in which it has drilled its way through the casing wall and is located outside the casing.

Figure 1:
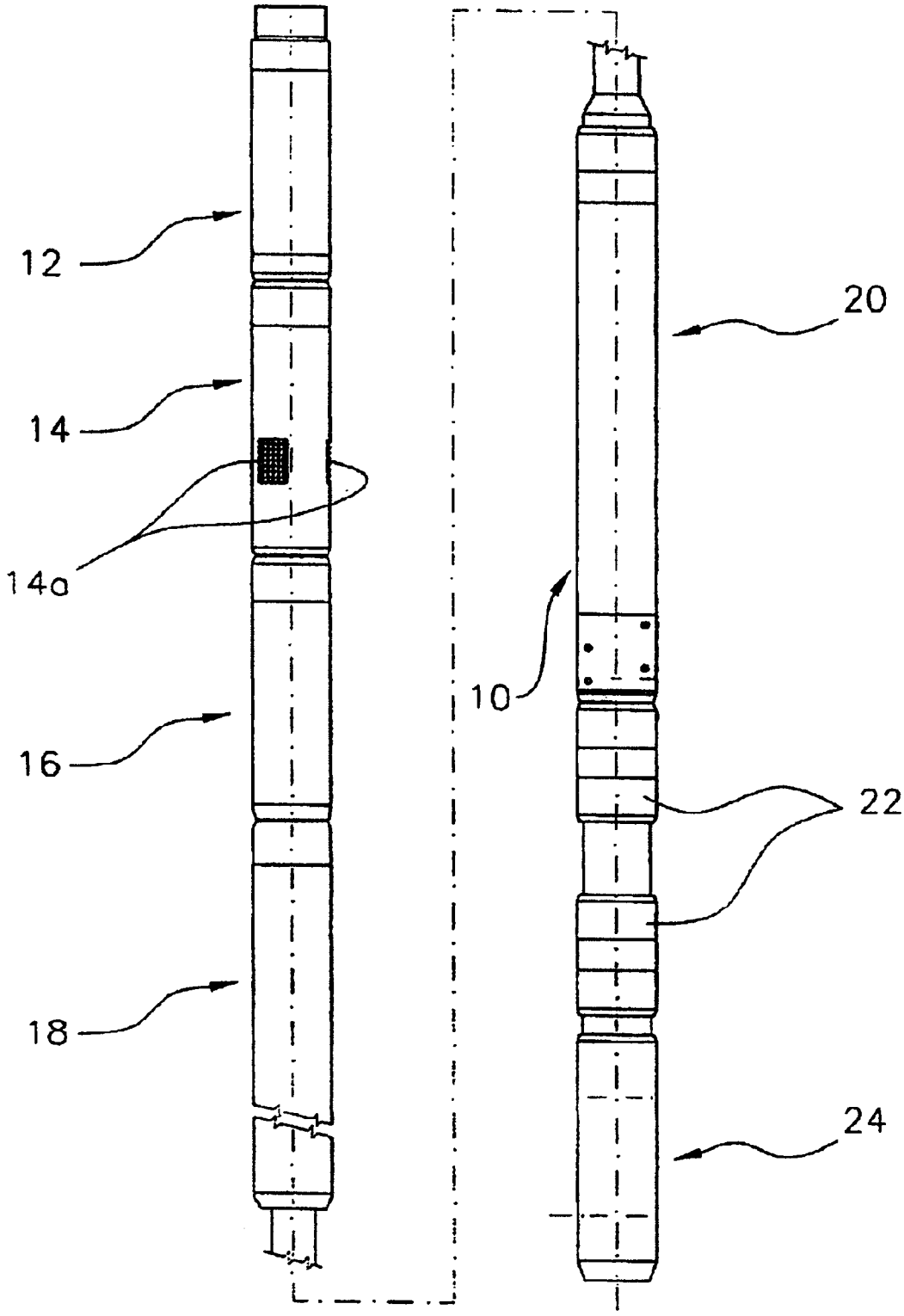
FIG. 1 shows, in a side view, a downhole tool or more specifically its greatly elongated, sleeve-shaped/tubular housing, which is shown so that a first upstream longitudinal portion is shown to the left of an axial extension/continuation portion of the same tool housing.

In FIG. 1 the reference numeral 10 identifies a downhole tool in general and its elongated straight sleeve-shaped/tubular outer housing.

The positioning of the different components of the tool 10, as in FIG. 1, apart from an anchoring device 14*a* consisting of different radially expandable/withdrawable keys placed at the same level for fixing the position of the tool, is hidden by the tool housing 10, and it is the fixed-level locations of these components that are indicated by the reference numerals 12, 14, 16, 18, 20, 22 and 24.

Thus, the reference numeral 12 identifies the location of a control package comprising electronics, a pump and valves for monitoring/controlling hydraulically conditioned functions of components located in the downstream direction of the equipment;

14 identifies the location of the anchoring device 14*a*, already mentioned, which may be of a type known in itself and form the position-fixing and securing device of the tool, ensuring a non-rotatable, axially non-displaceable securing of the tool within the well;

16 identifies the location of a device called rotary device arranged to initiate a rotary motion during axial movement;

18 identifies the location of a torque-absorbing extendable/shortenable cylinder device;

20 identifies the location of a jetting hose drum with feeding device;

22 identifies the location of a drilling device with holding-up means; and

24 identifies the location of a motor for driving the drilling device.

In the embodiment of a downhole tool described in the following and shown in the drawings, for the drilling of transverse holes through the pipe wall of a casing, and for channel-forming jetting of surrounding sedimentary rock, starting from said hole in the casing wall for radial extension and subsequent withdrawal of a jetting hose, only one drilling device and only one jetting hose are used.

According to FIG. 2 the greatly elongated downhole tool 10 is placed coaxially in a casing string 26 extending vertically and being shown in a vertical axial view.

The non-rotatable, axially non-displaceable, securing locking-device 14*a* fixing the tool position is shown on a large scale in a partial view according to FIG. 3. This radially expandable/contractible locking device 14*a* known in itself, consists of cuneiform segments spaced apart by uniform angular distances round the tool housing 10*a*, and has radially projecting, friction-increasing teeth, points or similar projections, as appears from FIG. 3. The segments 14*a* may be pushed out by means of hydraulic pressure. As both the constructional configuration and the operation are well known to a person skilled in this and related technical fields, this construction/function will not be described in further detail.

In FIG. 4 the drilling means 28 is shown in a position, in which it has just drilled its way through the casing wall 26. Further details of the drilling means 28 and the moving/control devices arranged thereto will be reverted to later; for the moment it should only be mentioned, referring to FIG. 4, that the reference numeral 30 identifies a motor for the rotation of the drilling means 28 about the longitudinal axis thereof.

FIG. 5 shows a radially displaceable holding-up means 32 for the tool 10, especially for the drilling means 28, which is arranged in a transverse cylinder 34 formed in the lower end portion of the tool housing 10*a*, and which has narrow channels 36, 38 for hydraulic fluid arranged thereto, by which the holding-up means 32 is forced against the pipe wall surface 26*a* during the active period of the drilling means 28, thereby keeping the lower end portion of the tool housing supported and stabilized during the operations of the drilling means 28. In FIGS. 16 and 17 the holding-up means 32 is shown in its active position both when the drilling means 28 is in its withdrawn position, retracted into the inner cavity of the tool housing 10*a* (FIG. 16), and when the drilling means 28 is in its pushed-out position, with the drill located outside the outer mantle surface of the tool housing 10*a*, see FIG. 17, after having performed its drilling task and drilled a through transverse hole 40 through the casing wall 26.

Further details of these drawn FIGS. 16 and 17 will be reverted to later in connection with the monitored/controlled movement of the drilling means 28 between a radially extended active position and a retracted inactive position.

In the embodiment shown the holding-up means 32 has essentially the form of a piston with a piston rod and is arranged in the cylinder space 34 of the lower housing end portion of the downhole tool 10. The holding-up means 32 is hydraulically operated, and it should be clear how it works, its constructional embodiment and location relative to the drilling means 28 ensuring holding up and possibly securing of the tool 10 in the area of the working area of the drilling means 28.

FIG. 6, which essentially corresponds to FIG. 2, shows schematically a radially extended jetting means in the form of an elastic flexible jetting hose 42, which has at its free end a working head or nozzle head 42*a* equipped with nozzles whose jets are directed forwards, i.e. away from the tool 10 and the casing wall, and rearwards, i.e. in the opposite direction, the forward nozzle jets being identified by A and the rearward nozzle jets by B.

The jets A from the first nozzles arranged in the nozzle head 42*a* are mainly flushing jets, whereas the jets B from the second nozzles arranged in the nozzle head are the propulsion jets of the jetting means 42, which utilize reaction surfaces forming by and by about the flushed/dug out sediment channel portion 44.

Said reaction surfaces for the rearward liquid/water jets from nozzles of the nozzle head 42*a* define this radial/transverse channel 44, which is jetted and dug out by the jetting hose 42 in the sediment surrounding the casing 26, see FIG. 7.

When the downhole tool 10 according to FIG. 2 is fixed in position by means of the anchoring device 14*a* and in this position is arranged axially non-displaceable/non-rotatable within the casing 26, and the holding-up means 32 has been pushed out, ensuring optimum working conditions for the drilling means 28, see FIGS. 2, 4, 16 and 17, the drilling means 28 is in its protected, inactive stand-by position retracted in the tool housing 10*a*, see FIG. 16.

Through a bevel gear 30*a* the driving motor of the drilling means 28, in the form of the electric motor 30, is engaged in an upright gear/gear rim 30*b*, which transfers rotary motion by way of splines 30*c* to the drill 28, generally and jointly identified by 46.

It is the task of the electric motor 30 and the transmission mechanism 30*a,b,c*,46 to rotate the drilling means 28 when this is to drill the hole 40 through the casing wall 26

Thus, the drive motor 30 is only engaged when the drilling means 28 is ready to carry out a drilling operation and thus is in an inactive stand-by position according to FIG. 16, and is brought to stop when the drilling means 28—see FIGS. 2 and 16—has finished the drilling operation, and it is desirable that the jetting means 42,42*a* is put to use to perform its channel-jetting/-digging operation, FIGS. 7–15, which will be reverted to after the movements of the drilling means 28 and the moving and controlling mechanism thereof have been described in connection with FIGS. 4, 16 and 17.

The drilling means 28 with the drill bit on its outer free end has an axle 28*a* which is supported by means of bearings 48, 50 and is axially glidably displaceable within a fixed supporting sleeve 52 secured to the gear rim 30*b*.

The end of the axle 28*a* of the drilling means 28 opposite the drill bit is linked 54 to one outer end of a two-armed lever 56 included in a link arm system 56,58,60 forming the motion transmission mechanism for the radial displacing motion of the drilling means 28 between an active outward motion during drilling and an inward motion into an inactive standby/protected position, in which it has been retracted into the tool housing 10*a*.

In addition to the link arm 56 which is pivotably supported as a two-armed lever on a transverse axis relative to the longitudinal axis of the tool/tool housing 10/10*a*, said link arm system 56,58,60 comprises an upstream straight link arm 60 and an intermediate angled link arm 58.

The link arm 56 supported as a two-armed lever pivots on a stationarily positioned link 62, whereas the angled arm 58, which has a sharp angle, pivots on a transverse link 64 which has limited displaceability within a groove or slot 66 formed in the tool housing 10*a*, extending in the direction of the longitudinal axis of the tool 10.

The connecting links of the angled intermediate link arm 58 to the axially outer link arms 56 and 60 of the link arm system are identified by 68 and 70.

At its upstream end the straight upstream link arm 60 is linked 72 to a downstream securing element 74 on a piston 76 of limited axial displaceability, which is arranged in a cylinder space 78 within the tool housing 10*a* and has a first downward-facing stop surface 76*a* which cooperates, in one end position of the link arm system 56,58,60, with a first internal, transverse stop surface 10*b* of the tool housing 10*a*.

The piston 76 has a second, upward-facing stop surface 76*b* which cooperates, in the other end position of the link arm system 56, 58, 60, with a second internal transverse stop surface 10*c* of the tool housing 10*a*. To either side of the upper portion of the piston 76 are leading hydraulic channels 76*a* and 76*c*.

Based on the above explanation and the two FIGS. 16 and 17 it should be clear how the drilling means 28 is moved by means of the piston 76 which is influenced by pressurized hydraulic fluid in the cylinder chamber 78, the link arm system 56,58,60 and the gliding displaceability of the drilling means within the transverse guide sleeve 52, between its inactive, withdrawn end position, in which it is protectively retracted into the inner cavity of the tool housing 10*a*, FIG. 16, and the end position of the drilling means 28, FIG. 17, in which it has completed its task and drilled out a through transverse hole 40, see FIG. 7, in the casing wall 26.

This transverse hole 40, which will be one of several, later serves as inflow hole for hydrocarbons.

However, the transverse holes 40 also serve as passage holes for a jetting/digging means in the form of the jetting hose 42, already mentioned, with the nozzle head 42*a*, FIG. 7, which performs its task by working the formation prior to the production phase. The fact is that it is desirable to jet/dig out radial channels 44 to open up and loosen the sediment which is assumed to be of moderate compactness/hardness, so that for jetting/digging and propelling purposes, a jetting means driven by pressurized fluid/water on the basis of nozzles, comprising a nozzle head 42*a* with nozzles for forward and rearward liquid jets A and B, may work its way by a desired length into the sediment.

This jetting/digging, channel-forming arrangement has been visualized particularly in FIGS. 7–15 and comprises as its most important component an elastically pliant, flexible hose 42 with a nozzle head 42*a*, already described, on its outer free end, which is arranged to be pushed out through one by one of the transverse holes 40 drilled by the drilling means 28 in the casing wall 26, in order thereby, during radially feed-out from the tool housing 10*a*, to jet and dig out channels 44 in the surrounding sediment 80, FIG. 7, for the purpose explained in the foregoing.

It may be desirable to complete one transverse hole 40 in the casing wall 26, and the outside sediment channel 44 directed aligned with the transversal hole 40, in two successive operations.

When one transverse hole 40 has been drilled in the casing wall 26, such a working method/cycle relies on a lowering of the tool 10 by means of lowering/lifting equipment, discussed earlier, so that the outer end/nozzle head 42*a* of the jetting hose 42 is positioned directly opposite this specific transverse hole 40.

Then, by means of its feeding device and the rearward liquid jets B of the nozzle head 42*a*, the jetting hose 42 may jet/dig its way outwards into the sediment 80 while maintaining an approximately radial course relative to the longitudinal axis of the tool 10.

At its lower portion the jetting hose 42 has a bed element 82 arranged thereto, which extends downwards/sideways in a convex curve and is provided with a smooth coating on the bearing/gliding surface facing the hose 42. The bed element 82 is secured to a switch lever 84.

By its upstream portion the jetting hose 42 is wound onto an internally sleeve-shaped core of a double-walled drum 86 with a vertical axis. The drum 86 is supported by means of axial bearings 88 and is rotated by means of a motor 90 through a gear 92 on the take-off axle thereof and a gear rim which is engaged therein and formed in the drum 86.

As mentioned, the side wall of the drum 86 is double, the outer drum side wall being identified by 86*a* and the inner drum side wall by 86*b*. The inner side wall 86*b* is provided with a threaded portion 94 which has a pitch corresponding to the pitch adopted by the jetting hose 42 wound onto the drum 86, the aim thereby being a synchronous unwinding of the hose 42.

A feeding sleeve 96 is guided along axial gliding strips, splines, 98, FIG. 10, secured to an inner pipe 100, which is secured in its turn to the tool housing 10*a*. The feeding sleeve 96 is formed with gliding grooves 102 for feeding forward the hose 42. To said inner pipe 100 is attached a telescope pipe 104, FIGS. 14 and 15, which is glidingly displaceable inside a tubular portion 96*a* of the feeding sleeve 96.

Nozzles inside the nozzle head 42*a* contributes to pulling the jetting hose 42,42*a* into the formation sediment 80, and the feeding forward is initiated by the rotating motor 90 of the hose drum 86 through the gear/gear rim transmission 92.

The switch lever 84 is pivotable about a transverse axis 106, FIG. 8, and bears from above on a switch/change-over means 108. By too great a feeding speed relative to the real penetrating speed of the jetting hose 42,42*a* into the sediment 80, the hose 42 will force the switch lever 84 down, so that the switch/change-over means 108 is activated. Electronics, well known in itself, is thereby put into function, causing a slight counter-rotation of the motor 90 and thereby of the hose drum 86, so that the active portion of the jetting hose is pulled back slightly. The jetting sequence then continues in the same way until the desired length of the hole has been obtained.

The drum motor 90 is reversed when the jetting hose 42 is to be reeled into the tool housing 10*a* onto the drum 86. This operation is initiated when the sediment channel 44 has been given its desired length; when available hose length has been used up or when the jetting device is to be moved to a new hole 40, from which a channel 44 is to be drilled into the sediment, which happens after the tool and thereby the jetting hose head 42*a* have been moved levelwise and/or in a circumferential direction.

The feeding means 96 of the jetting hose 42 has two end positions, one being illustrated in FIG. 8, corresponding to the maximally retracted, inactive and partly wound stand-by position of the jetting hose 42, in which the working/nozzle head 42*a* is immediately within the side surface of the tool house mantle, and one in FIG. 10, corresponding to the fully extended active position of the jetting hose 42.

In the end position in FIG. 8, corresponding to the inactive, retracted stand-by position, the feeding device 96 has been stopped and is prevented from moving further in the downstream direction by a stop disc 110 against the upward end surface 110*a* of which the downward end surface 96*a* of the feeding body 96 comes to bear in its end position shown in FIG. 8.

What is claimed is:

1. A tool for perforation of a longitudinal wall section of a pipe (26) in a production zone of a hydrocarbon-producing well and loosening/perforating externally located sedimentary rock (80), wherein a tool (10) is used, which is arranged to be lowered into the well and hauled up there from, said tool (10) comprising an elongated tool housing (10*a*) of sleeve-shaped/tubular configuration along the major part of its length, wherein is enclosed at least one drilling means (28) and at least one jetting means (42) and a supporting holding-up means (32), the tool housing (10*a*) being formed with a radial transverse opening for each means (28, 42, 32), and where to the said drilling means (28) is arranged a driving motor (30) for the supply of rotary energy required during drilling, and a driven, controlled moving mechanism (56,58,60,76,78) for moving the drilling means (28) between an inactive stand-by position within the outer mantle surface of the tool housing (10*a*), and an active drilling position, in which it is arranged, by activation of the driving motor (30), to drill its way through an adjacent pipe wall (26), and said jetting means (42) has the form of an elastically flexible jetting hose with an outer propulsion head in the form of a nozzle head (42*a*) with pressure liquid supply, said jetting hose (42) having a feeding device (96) and guides/control means (82, 102) arranged thereto, for moving the jetting hose (42) and transferring same from an inactive stand-by position within the outer wall of the tool housing (10*a*) into a moving position, in which it is moved radially outwards from the tool housing (10*a*), first through a hole (40) of the pipe wall (26) that the drilling means (28) has drilled, and then into the sediment (80) surrounding the pipe (26), characterized in that the drilling means (28) has a coaxial shaft (28*a*), which opposite the drilling means 28, which is positioned at a radially outer end, is connected to a link arm system (56,58,60) driven by an axially reciprocating piston device (76,78) in order to provide—by the axially reciprocating displacing motion of a piston (76) in a cylinder (78) which is formed in the tool housing (10*a*) and has a longitudinal axis that coincides with the axis of the tool housing—a controlled transfer of the drilling means (28) between its active position and its inactive position and vice versa.

2. A tool as claimed in claim 1, characterized in that the jetting hose (42) has a drum (86) arranged thereto for the winding/unwinding of the hose, and in connection therewith a feeding body (96) reciprocatingly displaceable axially, said drum (86) having an axial axis of rotation and a double wall (86*a*, 86*b*), the two concentric walls defining between themselves an annular space for the reception of some turns of the hose in the inactive position of the jetting hose (42), in which the working/nozzle head (42*a*) is retracted radially within the outer mantle surface of the tool housing (10*a*).

3. A tool as claimed in claim 2, characterized in that the jetting hose feeding body (96) has an upstream, partly helical hose-guiding groove (102) which merges with an essentially axial guiding groove, in which there is arranged a telescope pipe (104), and whose downstream end merges into a curved guiding element or bed (82) for the gliding displacing motions of the jetting hose (42).

4. A tool as claimed in claim 3, characterized in that below a jetting hose portion within the tool housing (10*a*) adjacent to the working/nozzle head (42*a*) of the hose, in the active position, is arranged an interacting arm (84), which is arranged to influence and cooperate, when feeding speed exceeds real hose penetration speed into the sediment (80), with a change-over means in the form of a switch (108), which again influences driving motor (90) for drum 86 and feeding body 96 of the jetting hose to reverse for re-establishing the feeding conditions.

5. A tool as claimed in claim 2, characterized in that below a jetting hose portion within the tool housing (10*a*) adjacent to the working/nozzle head (42*a*) of the hose, in the active position, is arranged an interacting arm (84), which is arranged to influence and cooperate, when feeding speed exceeds real hose penetration speed into the sediment (80), with a change-over means in the form of a switch (108), which again influences driving motor (90) for drum 86 and feeding body 96 of the jetting hose to reverse for re-establishing feeding conditions.

6. A tool as claimed in claim 1, characterized in that the jetting hose feeding body (96) has an upstream, partly helical hose-guiding groove (102) which merges with an essentially axial guiding groove, in which there is arranged a telescope pipe (104), and whose downstream end merges into a curved guiding element or bed (82) for the gliding displacing motions of the jetting hose (42).

7. A tool as claimed in claim 6, characterized in that below a jetting hose portion within the tool housing (10*a*) adjacent to the working/nozzle head (42*a*) of the hose, in the active position, is arranged an interacting arm (84), which is arranged to influence and cooperate, when feeding speed exceeds real hose penetration speed into the sediment (80), with a change-over means in the form of a switch (108), which again influences driving motor (90) for drum 86 and feeding body 96 of the jetting hose to reverse for re-establishing feeding conditions.

8. A tool as claimed in claim 1, characterized in that below a jetting hose portion within the tool housing (10*a*) adjacent to the working/nozzle head (42*a*) of the hose, in the active position, is arranged an interacting arm (84), which is arranged to influence and cooperate, when feeding speed exceeds real hose penetration speed into the sediment (80), with a change-over means in the form of a switch (108), which again influences driving motor (90) for drum 86 and feeding body 96 of the jetting hose to reverse for re-establishing feeding conditions.

* * * * *